US006684508B2

(12) United States Patent
Brzesowsky et al.

(10) Patent No.: US 6,684,508 B2
(45) Date of Patent: Feb. 3, 2004

(54) SHAVING HEAD WITH DRIVABLE HAIR MANIPULATOR AND DRIVABLE CUTTING MEMBER

(75) Inventors: Rudolf Heinrich Brzesowsky, Eindhoven (NL); Andreas Johannes Garenfeld, Eindhoven (NL); Lucien Ferdinand Anna Douven, Eindhoven (NL); Jasper Zuidervaart, Drachten (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 108 days.

(21) Appl. No.: 09/741,974

(22) Filed: Dec. 20, 2000

(65) Prior Publication Data

US 2001/0015017 A1 Aug. 23, 2001

(30) Foreign Application Priority Data

Dec. 24, 1999 (EP) ..... 99204529

(51) Int. Cl.[7] ..... B26B 19/42; B26B 19/02

(52) U.S. Cl. ..... 30/43.91; 30/34.2; 30/43.92

(58) Field of Search ..... 30/43.42, 34.2, 30/43.91, 45

(56) References Cited

U.S. PATENT DOCUMENTS 3,834,017 A * 9/1974 Tolmie ..... 30/34.2
3,919,769 A * 11/1975 Horn ..... 30/30
3,945,115 A * 3/1976 Daniels et al. ..... 30/34.2
3,967,372 A * 7/1976 Beck et al. ..... 30/34.1
4,159,566 A * 7/1979 Patrin ..... 30/220
4,866,843 A * 9/1989 Kumano ..... 30/34.1
6,098,288 A * 8/2000 Miyagawa et al. ..... 303/43.91
6,276,060 B1 * 8/2001 Faulstich et al. ..... 30/34.1
6,308,414 B1 * 10/2001 Parsonage et al. ..... 30/43.91

FOREIGN PATENT DOCUMENTS

EP 0855256 B1 * 8/1999 ..... B26B/21/00
WO WO 9735691 A1 * 10/1997 ..... B26B/19/28
WO WO 9801265 A2 * 1/1998 ..... B26B/19/26

* cited by examiner

*Primary Examiner*—Allan N. Shoap
*Assistant Examiner*—Isaac Hamilton
(74) *Attorney, Agent, or Firm*—Ernestine C. Bartlett

(57) ABSTRACT

A shaving head comprises a cutting member a hair manipulator. The cutting member has a cutting edge which extends in a direction perpendicular to a shaving direction of the shaving head. The hair manipulator is arranged in front of the cutting edge, seen in the shaving direction, and can be driven in a direction parallel to the cutting edge. Hairs trapped by the hair manipulator are moved along the cutting edge while being cut, so that the cutting forces in the shaving direction are reduced. The cutting member can also be driven in a direction parallel to the cutting edge such that, seen in this direction, the cutting member and the hair manipulator move in opposite directions for a longer period of time than in equal directions. In this manner the cutting member has a stretching effect on the skin present immediately in front of the cutting edge, and said stretching effect of the cutting member intensifies a similar stretching effect of the hair manipulator.

5 Claims, 3 Drawing Sheets

SHAVING HEAD WITH DRIVABLE HAIR MANIPULATOR AND DRIVABLE CUTTING MEMBER

Figure 1:
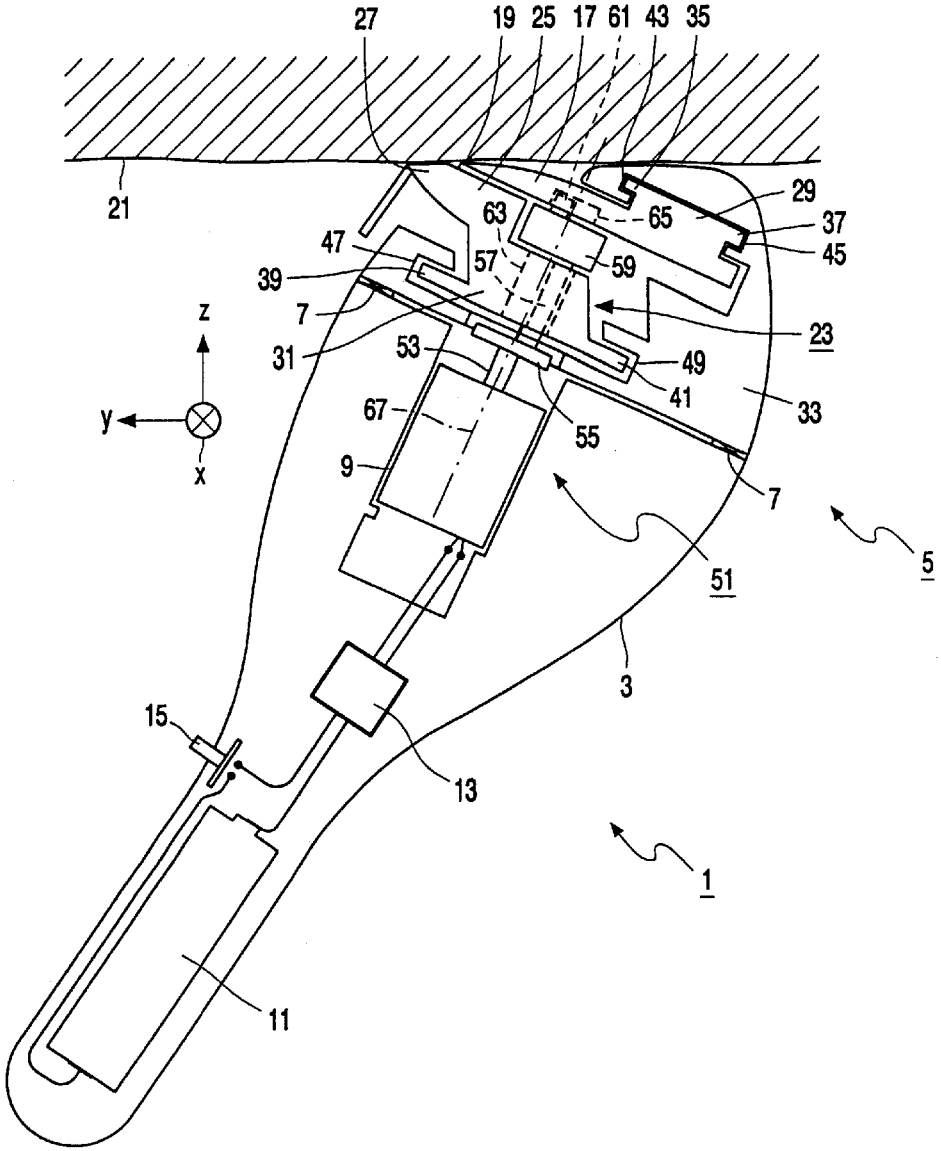

The invention relates to a shaving head provided with a cutting member which has a cutting edge for cutting hairs which grow from skin, and with a hair manipulator which is arranged in front of the cutting edge, as seen in a shaving direction of the shaving head, and which can be driven in a direction substantially parallel to the cutting edge for moving the hairs in a direction substantially parallel to the cutting edge.

The invention also relates to an electric shaver provided with a shaving head and a drive unit, in which the shaving head is provided with a cutting member which has a cutting edge for cutting hairs growing from skin, and with a hair manipulator which is arranged in front of the cutting edge, as seen in a shaving direction of the shaving head, and which can be driven by means of the drive unit in a direction substantially parallel to the cutting edge for moving the hairs in a direction substantially parallel to the cutting edge.

A shaving head and an electric shaver of the kinds mentioned in the opening paragraphs are known from EP-B-0 855 256. The cutting member of the known shaving head and the known electric shaver comprises a straight cutting edge which extends perpendicularly to the shaving direction and is arranged in a fixed position in the shaving head. The hair manipulator comprises a comb which is arranged parallel to the cutting edge with teeth which extend substantially perpendicularly to the cutting edge. Reciprocal displacements of the hair manipulator relative to the cutting member are generated in a direction parallel to the cutting edge by means of the drive unit during operation. When a user moves the shaving head in the shaving direction over the skin, the hairs are first caught between the teeth of the hair manipulator. The teeth have comparatively small interspacings, so that reciprocal movements of the hairs in a direction substantially parallel to the cutting edge are generated by the hair manipulator, and the hairs are moved to and fro along the cutting edge during cutting. The result of this is that a required cutting force in the shaving direction for cutting through the hairs is considerably reduced, whereby the shaving performance and the shaving comfort offered by the shaving head are considerably improved. The hair manipulator also offers the skin a protection against skin damage and skin irritation. As a result of the displacement of the shaving head in the shaving direction over the skin, the skin is stretched immediately in front of the cutting edge in a direction parallel to the shaving direction by means of the teeth of the hair manipulator, so that comparatively large skin folds in front of the cutting edge, which could cause skin cuts, are largely prevented. As a result of said reciprocal movements of the hair manipulator, in front of the cutting edge the skin is also stretched parallel to the cutting edge, so that also comparatively small skin folds between the teeth of the hair manipulator, which could cause minor skin damage or skin irritation, are largely prevented.

It is a disadvantage of the known shaving head and the known electric shaver that the hair manipulator used therein does not completely prevent skin cuts and skin irritation. This is because there is only a limited frictional force present between the hair manipulator and the skin, with the result that the hair manipulator glides over the skin for the major part during said reciprocal displacements. The hair manipulator thus stretches the skin parallel to the cutting edge to a limited degree only, so that skin folds in front of the cutting edge are not completely prevented.

It is an object of the invention to provide a shaving head and an electric shaver of the kinds mentioned in the opening paragraphs with which the skin immediately in front of the cutting edge is better stretched, so that the disadvantage of the known shaving head and the known electric shaver mentioned above is obviated as much as possible.

To achieve this object, a shaving head according to the invention is characterized in that the cutting member can be driven in a direction parallel to the cutting edge such that the cutting member and the hair manipulator move in opposite directions for longer periods than in equal directions, as seen parallel to the cutting edge, during operation.

To achieve this object, an electric shaver according to the invention is characterized in that the shaving head used therein is a shaving head according to the invention.

Since the cutting member can be driven in a direction parallel to the cutting edge, a frictional force directed parallel to the cutting edge is present between the cutting member and the skin as a result of displacements of the cutting member relative to the skin in said direction. The result is that the skin lying immediately in front of the cutting edge is stretched in a direction parallel to the cutting edge not only by the hair manipulator, but also by the cutting member. Since the cutting member and the hair manipulator move in opposite directions, as seen parallel to the cutting edge, for longer periods than in equal directions during operation, the frictional forces exerted by the cutting member and the hair manipulator on the skin present directly in front of the cutting edge have opposite directions more often than equal directions over a predetermined period of time. Since the points of application of the frictional forces of the cutting member and of the hair manipulator on the skin lie at a distance from one another, a shearing stress present in the skin lying immediately in front of the cutting edge as a result of the frictional force of the hair manipulator is increased by the frictional force of the cutting member, when averaged over said period of time. The cutting member thus reinforces the stretching action performed by the hair manipulator on the skin present immediately in front of the cutting edge, so that skin folds immediately in front of the cutting edge are further limited, and skin cuts and skin irritation are prevented to a greater extent. An additional advantage is that the hairs are displaced relative to the cutting edge with a higher velocity, seen parallel to the cutting edge and averaged over a predetermined period of time, during cutting, so that the cutting force required in the cutting direction for cutting the hairs is further reduced. Since the hair manipulator and the cutting member can both be driven in a direction parallel to the cutting edge, i.e. in a direction perpendicular to the shaving direction, a frictional force present between the hair manipulator and the skin and a frictional force present between the cutting member and the skin have only comparatively small components in a direction parallel to the shaving direction, so that the user only experiences a comparatively small frictional force in the displacement of the shaving head in the shaving direction over the skin. The shaving comfort is further enhanced thereby.

A special embodiment of a shaving head according to the invention is characterized in that the cutting member and the hair manipulator can be driven into oscillatory movements having the same frequency and a mutual phase difference of between 90° and 270°, as seen parallel to the cutting edge. If the cutting member and the hair manipulator perform oscillatory movements with a mutual phase difference of between 90° and 270°, the cutting member and the hair manipulator will move more often in opposite directions than in equal directions parallel to the cutting edge, seen over one cycle of the oscillatory movement, so that the mutually reinforcing stretching actions of the hair manipulator and the cutting member on the skin present immediately in front of the cutting edge are provided by means of movements of the hair manipulator and the cutting member which can be realized in a simple manner.

A further embodiment of a shaving head according to the invention is characterized in that said phase difference is substantially equal to 180°. If the cutting member and the hair manipulator perform oscillatory movements in a direction parallel to the cutting edge with a mutual phase difference of 180°, the cutting member and the hair manipulator will move continuously in mutually opposed directions, so that the mutually reinforcing stretching actions of the hair manipulator and the cutting member on the skin present immediately in front of the cutting edge are a maximum. The fact that the cutting member and the hair manipulator continuously move in mutually opposed directions means that mass forces exerted by the cutting member and the hair manipulator on the shaving head as a result of the oscillatory movements compensate each other, provided the values of the displaceable masses of the cutting member and the hair manipulator are suitably chosen, so that the shaving head is substantially free from vibrations.

A yet further embodiment of a shaving head according to the invention is characterized in that the phase difference is approximately 135° or approximately 225°. This yet further embodiment not only achieves a considerable enhancement of the mutually reinforcing stretching actions of the hair manipulator and the cutting member on the skin present immediately in front of the cutting edge, but it also provides a considerable probability of a temporary clamping of the hairs between the hair manipulator and the cutting member. Such a temporary clamping has the result that hairs are first pulled from the skin over some distance before the hairs are cut through by the cutting member. An achievable skin smoothness is considerably increased thereby.

Figure 2:
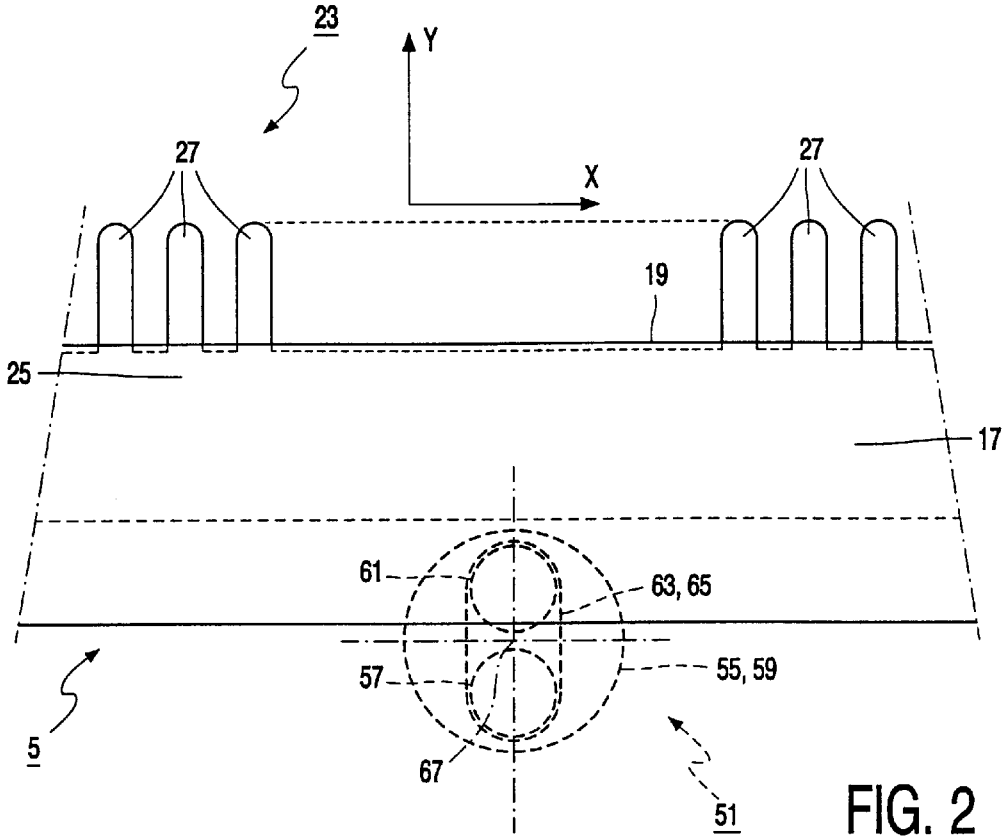
Figure 3:
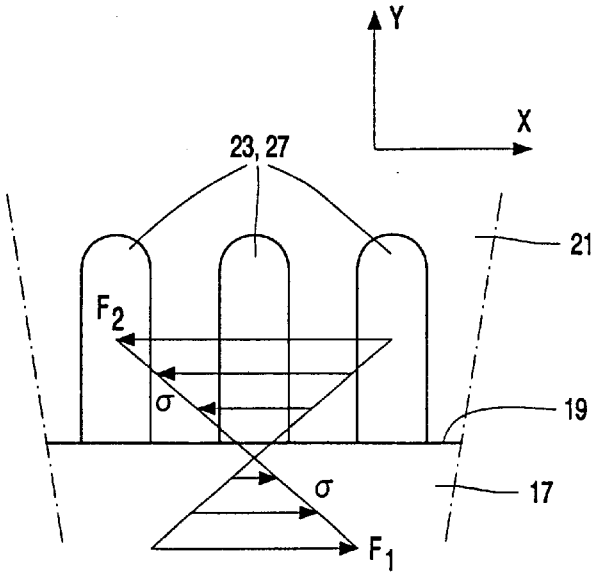
Figure 4:
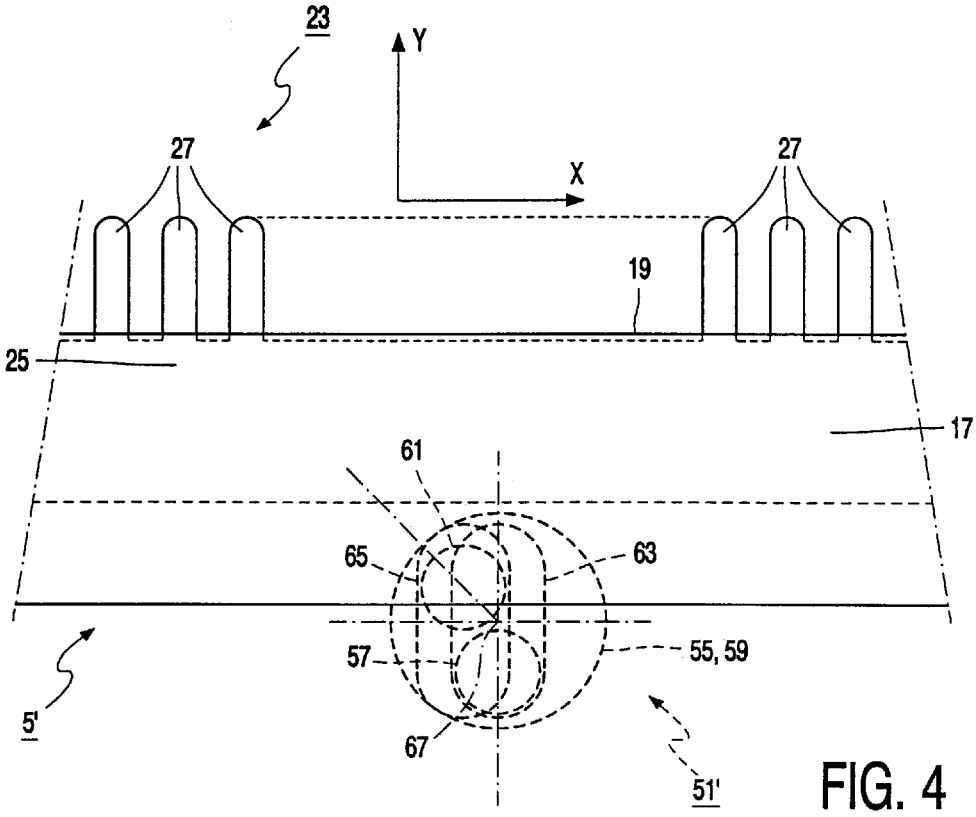
Figure 5:
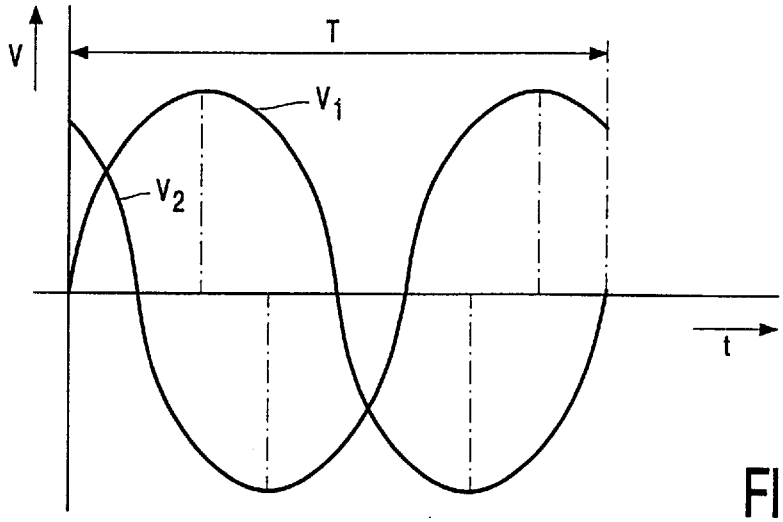

The invention will be explained in more detail below with reference to a number of embodiments thereof as shown in the drawing, in which FIG. 1 diagrammatically shows an electric shaver according to the invention which is provided with a shaving head according to the invention, FIG. 2 is a diagrammatic plan view of a portion of the shaving head of the electric shaver of FIG. 1, FIG. 3 diagrammatically depicts a stretching action exerted by a hair manipulator and a cutting member of the shaving head of the electric shaver of FIG. 1 on the skin present in front of the cutting member, FIG. 4 is a diagrammatic plan view of a portion of an alternative embodiment of a shaving head according to the invention, and FIG. 5 plots the velocities with which a cutting member and a hair manipulator of the shaving head of FIG. 4 are displaced parallel to a cutting edge of the cutting member.

The electric shaver 1 according to the invention shown in FIG. 1 comprises a housing 3 on which a shaving head 5 according to the invention is detachably fastened by means of fastenings 7 which are shown diagrammatically only in FIG. 1 for simplicity's sake and which may be of a kind which is usual and known per se. In the housing 3, there is an electric motor 9, a battery 11 for supplying the motor 9, and an electric control unit 13 for controlling the motor 9. The motor 9 can be switched on and off by means of a switch 15 provided on the housing 3.

As FIGS. 1 and 2 show, the shaving head 5 is provided with a cutting member 17 which in the embodiment shown is plate-shaped and is provided with a straight cutting edge 19 for cutting hairs which grow from skin 21. The cutting edge 19 extends substantially parallel to an X-direction which is perpendicular to a shaving direction Y in which the shaving head 5 is to be displaced over the skin 21. The shaving head 5 further comprises a hair manipulator 23 which in the embodiment shown is provided with a comb 25. The comb 25 has teeth 27 which extend substantially perpendicularly to the cutting edge 19 and which are arranged with regular interspacings immediately in front of the cutting edge 19, as seen parallel to the shaving direction Y. It is noted that the teeth 27 are provided over substantially the entire length of the cutting edge 19, but that FIG. 2 shows only a few teeth 27 for simplicity's sake.

As FIG. 1 shows, the cutting member 17 is provided on a first carrier 29, and the comb 25 is provided on a second carrier 31. The first carrier 29 and the second carrier 31 are displaceably guided relative to a frame 33 of the shaving head 5, as seen parallel to the X direction, and are for this purpose provided with first guide elements 35, 37 and second guide elements 39, 41, respectively, for co-operating with first guide channels 43, 45 extending parallel to the X direction and second guide channels 47, 49 extending parallel to the X direction, respectively, which are provided in the frame 33. The two carriers 29 and 31 can be driven in directions parallel to the X direction by means of a drive unit 51 of the electric shaver 1, which unit is arranged partly in the housing 3 and partly in the shaving head 5 and comprises said motor 9. The drive unit 51 further comprises an output shaft 53 of the motor 9, a first coupling disc 55 arranged concentrically relative to the output shaft 53, a first drive pin 57 arranged eccentrically relative to the output shaft 53, a second coupling disc 59 arranged concentrically relative to the output shaft 53, and a second drive pin 61 arranged eccentrically relative to the output shaft 53. The output shaft 53, the two coupling discs 55 and 59, and the two drive pins 57 and 61 are arranged in fixed positions relative to one another, seen in a direction of rotation of the motor 9, the first drive pin 57 being detachably coupled to the first coupling disc 55, seen parallel to the output shaft 53, so as to enable a detachment of the shaving head 5 from the housing 3. The first drive pin 57 and the second drive pin 61 co-operate with a first slot 63 provided in the second carrier 31 and a second slot 65 provided in the first carrier 29, respectively. The first slot 63 and the second slot 65 extend in directions perpendicular to the X direction and have a width, seen parallel to the X direction, which corresponds substantially to a diameter of the first drive pin 57 and the second drive pin 61, respectively. A rotation of the output shaft 53 of the motor 9 is converted thereby into oscillatory movements of the cutting member 17 and the hair manipulator 23 relative to the frame 33 of the shaving head 5 in directions parallel to the X direction. As FIG. 2 shows, the two drive pins 57 and 61 in the embodiment shown are arranged in diametrical opposition with respect to a centerline 67 of the output shaft 53, so that there will be a phase difference of 180° between the oscillatory movements of the cutting member 17 and the hair manipulator 23 in the embodiment shown.

The oscillatory movements of the cutting member 17 and the hair manipulator 23 in the embodiment shown have a frequency of approximately 100 Hz and an amplitude of a few tenths of a millimeter. Since a friction coefficient present between the cutting member 17 and the skin 21 and a friction coefficient present between the hair manipulator 23 and the skin 21 have limited values, the cutting member 17 and the hair manipulator 23 will glide over the skin 21 as a result of the oscillatory movements, seen parallel to the X direction, a maximum frictional force $F_1$ being present between the cutting member 17 and the skin 21 parallel to the X direction, and a maximum frictional force $F_2$ being present between the hair manipulator 23 and the skin 21 parallel to the X direction. Since there is a phase difference of 180° between the oscillatory movements of the cutting member 17 and the hair manipulator 23, the cutting member 17 and the hair manipulator 23 will continuously move in opposite directions, as seen parallel to the X direction, so that said frictional forces $F_1$ and $F_2$ are continuously oppositely directed, as is diagrammatically shown in FIG. 3. If a user of the electric shaver 1 moves the shaving head 5 over the skin 21 in the shaving direction Y, the skin present immediately in front of the cutting edge 19 is stretched parallel to the shaving direction Y in that the teeth 27 of the hair manipulator 23 glide over the skin 21 parallel to the shaving direction Y. Comparatively large skin folds immediately in front of the cutting edge 19 are prevented thereby, so that skin cuts in such skin folds are prevented. Since the teeth 27 of the hair manipulator 23 also glide over the skin 21 parallel to the X direction as a result of said oscillatory movement of the hair manipulator 23, the skin present immediately in front of the cutting edge 19 is also stretched parallel to the X direction. Comparatively small skin folds present between the teeth 27 of the hair manipulator 23, which cause minor cuts or skin irritation through contact with the cutting edge 19, are also reduced. The cutting member 17 also has a straightening effect on the skin present immediately in front of the cutting edge 19 parallel to the X direction because the cutting member 17 glides over the skin 21 also parallel to the X direction as a result of said oscillatory movement. Since the frictional forces $F_1$ and $F_2$ have opposite directions and the points of application of the frictional forces $F_1$ and $F_2$, seen parallel to the shaving direction Y, lie at a small distance from one another, i.e. on either side of the skin present immediately in front of the cutting edge 19, the frictional forces $F_1$ and $F_2$ give rise to a comparatively great shearing stress a in the skin present immediately in front of the cutting edge 19, as is diagrammatically shown in FIG. 3. The oscillatory movement of the cutting member 17 thus reinforces the stretching effect of the oscillatory movement of the hair manipulator 23 on the skin present immediately in front of the cutting edge 19. Since the skin present immediately in front of the cutting edge 19 is thus strongly stretched, skin folds between the teeth 27 of the manipulator 23 are substantially completely prevented, so that skin cuts and skin irritation are also substantially completely prevented.

The electric shaver 1 according to the invention has the further advantage that cutting forces which are necessary in a direction parallel to the shaving direction for severing the hairs are reduced to a comparatively high degree as a result of the oscillatory movements of the cutting member 17 and the hair manipulator 23. When the user moves the shaving head 5 over the skin 21 in the shaving direction Y, the hairs are caught between the teeth 27 of the hair manipulator 23 and are taken along by the teeth 27 of the hair manipulator 23 parallel to the X direction, so that the hairs are moved to and fro along the cutting edge 19, as seen parallel to the X direction. A comparatively small interspacing of, for example, between 0.1 mm and 0.4 mm is for this purpose present between the teeth 27 each time. Since the cutting member 17 is continuously displaced in a direction opposed to that of the hair manipulator 23, seen parallel to the X direction, a comparatively great velocity difference obtains between the cutting edge 19 and the hairs to be cut through, seen parallel to the X direction. As a result, a frictional force experienced by the cutting member 17 during cutting of the hairs has only a comparatively small component in a direction parallel to the shaving direction Y. Since it is this component which determines the cutting force to be exerted by the user on the shaving head 5 parallel to the shaving direction Y for cutting through the hairs, this cutting force is strongly reduced in comparison with a cutting force experienced by the user of a comparable shaver having a stationary cutting member. Furthermore, the electric shaver 1 according to the invention has a similar advantage as regards the frictional forces present between the hair manipulator 23 and the skin 21 and between the cutting member 17 and the skin 21 experienced by the user during the displacement of the shaving head 5 over the skin in the shaving direction Y. Since the hair manipulator 23 and the cutting member 17 can both be driven in a direction parallel to the X direction, i.e. perpendicular to the shaving direction Y, the frictional forces present between the hair manipulator 23 and the skin 21 and between the cutting member 17 and the skin 21 have a comparatively small component in the shaving direction Y, so that the frictional force experienced by the user between the shaving head 5 and the skin 21 in the shaving direction Y is comparatively small. The electric shaver 1 in addition has the advantage, owing to said phase difference of 180°, that mass forces exerted by the cutting member 17 and the hair manipulator 23 on the shaving head 5 as a result of the oscillatory movements compensate each other, given a suitable value of the displaceable masses of the cutting member 17 and the hair manipulator 23, so that the shaving head 5 is substantially free from vibrations.

A reinforcement of the stretching effect of the movements of the hair manipulator directed parallel to the cutting edge on the skin present immediately in front of the cutting edge is not only achieved in an embodiment of the electric shaver and the shaving head as described above, in which the cutting member is displaced continuously in a direction opposed to the direction of the hair manipulator. FIG. 4 shows an alternative embodiment of a shaving head 5' according to the invention with which such a reinforcement of the stretching action is also achieved. In FIG. 4, components of the shaving head 5' corresponding to components of the shaving head 5 described above have been given the same reference numerals. The shaving head 5' differs from the shaving head 5 mainly in that the shaving head 5' is provided with a drive unit 51' in which the first drive pin 57 and the second drive pin 61 are arranged not in diametrical opposition with respect to the centerline 67 of the output shaft 53, but at an angle of approximately 135° (225°) relative to one another, as seen in a plane perpendicular to the output shaft 53. As a result, the cutting member 17 and the hair manipulator 23 of the shaving head 5' perform oscillatory movements parallel to the cutting edge 19 with a phase difference of 135° (or 225°). FIG. 5 is a diagram showing the velocities $V_1$ of the cutting member 17 and $V_2$ of the hair manipulator 23 in a direction parallel to the cutting edge 19 during one cycle T of the oscillatory movements. It is evident from the diagram that the cutting member 17 and the hair manipulator 23 move in opposite directions for approximately 75% of the cycle T, given said phase difference, and in the same direction for approximately 25% of the cycle T. Since the cutting member 17 and the hair manipulator 23 thus move in opposite directions for a longer portion of the cycle T than in equal directions, the frictional forces exerted by the cutting member 17 and the hair manipulator 23 on the skin present immediately in front of the cutting edge 19 have opposite directions more often than equal directions during the cycle T, so that the cutting member 17 reinforces the stretching action of the hair manipulator 23, averaged over the cycle T. Such a reinforcement by the cutting member of the stretching action of the hair manipulator also occurs in embodiments in which said phase difference lies between 90° and 270°, while the cutting member and the hair manipulator again perform oscillatory movements having the same frequency. According to the invention, however, such a reinforcement of the stretching action is also achieved in embodiments in which the cutting member and the hair manipulator are displaced parallel to the cutting edge other than in oscillatory movements, or are displaced in oscillatory movements of different frequencies and/or different amplitudes, and in which the cutting member and the hair manipulator move for longer periods in opposite directions than in equal directions, as seen parallel to the cutting edge, averaged over time or during a predetermined time period.

It was found, furthermore, that there is an increased probability of a temporary clamping of the hairs between the teeth 27 of the hair manipulator and the cutting edge 19 in the case of comparatively small velocity differences between the oscillatory movements of the cutting member 17 and those of the hair manipulator 23. The result of such a temporary clamping is that the hairs are first pulled from the skin over some distance before the hairs are cut through. This enhances a skin smoothness which can be achieved by the electric shaver. Since such comparatively small velocity differences between the cutting member 17 and the hair manipulator 23 occur more often in proportion as said phase difference lies further removed from 180° (in fact, said velocity difference is zero for a phase difference of 0° or 360°), the probability of hairs becoming clamped is a maximum in embodiments of a shaving head and an electric shaver according to the invention in which said phase difference is substantially equal to 90° or 270°. At such a phase difference, however, the stretching action of the cutting member and the hair manipulator mentioned above is a minimum. It was found that the embodiment of the shaving head 5' according to the invention discussed above, in which the phase difference is substantially equal to 135° or 225°, provides an approximately optimum compromise between said stretching action of the cutting member and the hair manipulator and said probability of clamping of the hairs, i.e. an approximately optimum compromise between the protective action against skin cuts and skin irritation and the achievable skin smoothness.

What is claimed is:

1. A shaving head comprising:

a cutting member, having a cutting edge for cutting hairs which grow from skin, the cutting member being driven to reciprocate with respect to the shaving head, and a hair manipulator driven to reciprocate with respect to the shaving head and with respect to the cutting member and in a direction substantially parallel to the cutting edge, the hair manipulator being arranged to contact the skin and to be adjacent the cutting edge, said hair manipulator engaging the hairs and, without cutting the hairs itself, moving the hairs along the cutting edge of the cutting member in a direction opposite to that in which the cutting member is moving to promote cutting of the hairs by the cutting edge, and wherein the cutting member and the hair manipulator move in opposite directions for longer periods than in the same direction parallel to the cutting edge.

2. A shaving head as claimed in claim 1 wherein the reciprocal cutting member and the reciprocal hair manipulator are drivable into oscillatory movements having the same frequency and a mutual phase difference of between 90° and 270°, in a direction parallel to the cutting edge.

3. A shaving head as claimed in claim 2, wherein the phase difference is substantially equal to 180°.

4. A shaving head as claimed in claim 2, wherein the phase difference is approximately 135° or approximately 225°.

5. An electric shaver comprising a shaving head as claimed in claim 1 further comprising a drive unit for driving the hair manipulator to reciprocate back and forth in a direction substantially parallel to the plane of the cutting edge of the cutting member.

* * * * *